US006136224A

United States Patent [19]

Wu et al.

[11] Patent Number: 6,136,224

[45] **Date of Patent: *Oct. 24, 2000**

[54] GAS GENERANT

[75] Inventors: Jianzhou Wu; Norimasa Hirata; Takushi Yokoyama, all of Hyogo, Japan

[73] Assignee: Daicel Chemical Industries, Ltd., Osaka, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/700,422

[22] PCT Filed: Dec. 27, 1995

[86] PCT No.: PCT/JP95/02732

§ 371 Date: Aug. 28, 1996

§ 102(e) Date: Aug. 28, 1996

[87] PCT Pub. No.: WO96/20147

PCT Pub. Date: Jul. 4, 1996

[30] Foreign Application Priority Data

Dec. 28, 1994 [JP] Japan ..... 6-328555
Apr. 28, 1995 [JP] Japan ..... 7-106121

[51] Int. Cl.[7] ..... C01B 11/14; C06B 45/10; C06B 41/00

[52] U.S. Cl. ..... 252/187.31; 149/19.2; 149/23; 149/36; 149/38; 149/42; 149/43; 149/45; 149/75; 556/57; 556/138; 556/170; 556/146; 556/181; 564/34

[58] Field of Search ..... 252/187.31; 149/17, 149/19.2, 23, 33, 34, 36, 38, 42, 43; 556/118, 57, 170, 146, 181, 45, 138; 564/34; 280/741, 736

[56] References Cited

U.S. PATENT DOCUMENTS

| | | | |
|---|---|---|---|
| H787 | 6/1990 | Collignon | 149/36 |
| 2,434,578 | 1/1948 | Miller | 44/355 |
| 2,659,688 | 11/1953 | Soule | 504/152 |
| 2,798,103 | 7/1957 | Schaeffer et al. | 585/817 |
| 4,053,567 | 10/1977 | Franz | 423/386 |
| 5,197,758 | 3/1993 | Lund et al. | 280/741 |
| 5,460,667 | 10/1995 | Moriyuki et al. | 149/36 |
| 5,516,377 | 5/1996 | Highsmith et al. | 149/18 |
| 5,536,339 | 7/1996 | Verneker | 149/19.5 |
| 5,542,704 | 8/1996 | Hamilton et al. | 280/741 |
| 5,592,812 | 1/1997 | Hinshaw et al. | 60/205 |
| 5,656,793 | 8/1997 | Ocsi et al. | 149/22 |
| 5,663,524 | 9/1997 | Bucerius et al. | 149/45 |

OTHER PUBLICATIONS

Derwent Abstract No. 94–313568, Abstract of JP–A–6–239683, (1994).
Gmelin Reg. No.: 619056 to MN • $3(H_3N_2\ CON_2H_3)$ • $2(NO_3)$ Taken from : Ivanov, M.G.; Kalinichenko, I.I., 2H. Neorg. Khim., Coden: Znokaq, 26 (1981), pp. 2134–2137 from the Russian Jour. Of Inorganic Chemistry.
Registry No.: 32096–70–1 to Zinc, bis(Hydrazine)–Dinitrato; Taken from Chemical Abstract No. 74: 150493 to Aliev R. Ya et al. (USSR). Zh. Neorg. Khim, 16(4) pp. 1079–1081 (1971).
Mem. poudres, (1952), vol. 34, 159–166.
Zh. Neorg. Khim., (1981), vol. 26 (8), 2134–2137.
Izv. Sib. Otd. Akad. Nauk SSSR, Ser. Khim. Nauk, (1982), (2), 89–90.
Izv. Sib. Otd. Akad. Nank SSR, Ser. Khim. Nauk, 1982(2), 89–92.
Zh. Neorg. Khim vol. 26(8), 1981, 2159–2162.
Tr.–Mosk.Khim.–Tekhnol. Inst. 104, 66–75 (1979).
Koordinatsionnaya Khimiya, vol. 8(7), 928–930 (1982).
Zh. Neorg. Khim vol. 26(8), 1981, 2134–2137.

*Primary Examiner*—Joseph D. Anthony
*Attorney, Agent, or Firm*—Birch, Stewart, Kolasch & Birch, LLP

[57] ABSTRACT

A gas generant for an air, which is improved in the defects of gas generants using sodium azide in a practical use and has stable combustion capability. And a molecular compound comprising (a) a gas generant component, (b) an oxidant component and (c) a reaction accelerator component, preferably represented by the composition formula (I).

$$M.mX.nY \quad (I)$$

[wherein, M is Al Mg, Ca, Cr, Cu, Zn, Mn, Fe, Co, Sr, Ni and another metal components; X is a nitrogen-containing compound having 0 or 1 carbon atom; Y is an anion such as $NO_3$ and ClO; m is a number of 1 to 3; and n is a number 2 to 3].

38 Claims, No Drawings

GAS GENERANT

FIELD OF INDUSTRIAL APPLICATION

The present invention relates to a gas generant composition which becomes an operating gas in an air bag system for protecting human bodies being mounted in automobiles, aircrafts or the like.

PRIOR ART

At present sodium azide is known as a gas generant used for an air bag system. A gas generant composition using sodium azide has no specific problems on the combustive characteristics thereof and is widely brought into a practical use. However, sodium azide has substantially unfavorable defects. For example, many patent publications in this field point out that a risk of decomposition and explosion, a formation of explosive compounds by reaction with heavy metals and environmental pollution problems which are worried at disposing in large quantities of sodium azide.

Therefore, means for solving these problems have been investigated, i.e., compounds have been investigated as a substitute for sodium azide. For example, a gas generant containing a complex of transition metals of an aminoalazol is disclosed in JP-A-5-213687, and a gas generant containing a carbodihydrazide is disclosed in JP-A-6-239683. These gas generants improve the defects of gas generants using sodium azide. However, the problems on a practical use, for example, existing in slight amount of gas components such as CO, $NO_X$ and $NH_3$ in the gas generants, can not be sufficiently solved.

Furthermore, in the prior art, a method for producing the final composition, as a gas generant composition, comprising gas generating component, oxidizing component and reaction accelerator mixed by physical mixing method has been much used. However, a lot of investigations are needed to solve the problem of a combustion lability caused by scatter of particle degree and physical mixed states, to overcome this problem and to obtain desired functions.

SUMMARY OF THE INVENTION

An object of the present invention is to provide a gas generant composition for an air bag, which is improved on its defects by using sodium azide, solves the problems in a practical use such as exsisting in slight amount of gas components in generated gas, and further, overcomes the combustion lability caused by scatter of particle degree and physical mixed states to give stabilized combustion capability thereto.

The present inventors have intensively studied and found that the problems the above can be solved by using a molecular compound containing gas generating component, oxidant component and acelerator component in the state of molecular or mixed atoms in one molecular compound of the gas generant composition.

The present invention is a gas generant comprising a molecular compound containing (a) a gas generating component, (b) an oxidant component and (c) a reaction accelerator component in its one molecular.

Preferably, the molecular compound is represented by the composition formula (I):

$$M.mX.nY \quad (I)$$

[wherein, M is the reaction accelerator component (c) representing Al, Mg, Ca, Cr, Cu, Zn, Mn, Fe, Co, Sr, Ni or another metals being capable to form the molecular compound of the composition formula (I); X is the gas generating component (a) representing a nitrogen-containing compound having 0 or 1 carbon atom; Y is the oxidant component (b) representing $NO_3$, $ClO_4$, Cl, I or another anions being capable to form the molecular compound of the composition formula (I); and, m and n are numbers determined by combinations of components (a), (b) and (c), usually m is a number of 1 to 3 and n is a number of 2 to 3].

More preferably, Y represents $NO_3$, $ClO_4$ or another anions of oxygen acid salts being capable to form the molecular compound of the composition formula (I). Furthermore, the molecular compound is selected from the group consisting of the following compounds.

$Zn.2(N_2H_4).2(NO_3)$,
$Zn.3(H_3N_2CON_2H_3).2(NO_3)$,
$Mn.3(H_3N_2CON_2H_3).2(NO_3)$,
$Mg.3(H_3N_2CON_2H_3).2(NO_3)$,
$Mn.2(H_3N_2CON_2H_3).2(NO_3)$,
$Ca.2(H_3N_2CON_2H_3).2(NO_3)$, and
$Sr.1(H_3N_2CON_2H_3).2(NO_3)$.

More preferably, the molecular compound is a metal complex of carbodihydrazide, further, M is Cu, Co, Ni, Mn or Zn, Y is $NO_3$, Cl or I, X is a carbodihydrazide (CDH), n is 2 and m is a number of 1 to 3. Most preferably, X is $NO_3$.

The present invention provides further a gas generant composition comprising a co-oxidant as a physically mixing component with the above molecular compound, and the composition may further comprise a bonding agent.

Preferably, the co-oxidant is at least one selected from the group consisting of an oxygen acid salt comprising a cation selected from alkaline metals or alkaline earth metals and a hydrogen not-containing anion, an ammonium nitrate and a metal peroxide. Moreover, the oxygen acid salt is a nitrate, a nitrite, a chlorate or perchlorate.

The present composition preferably comprises the metal complex of carbodihydrazide as the molecular compound, further, comprises the oxidant, and optionally the bonding agent if needed.

The present invention provides an air bag system using the gas generant described in the present claim 1, in an air bag system.

The gas generant component (a) in the molecular compound used in the present invention includes a nitrogen-containing compound having 0 or 1 carbon atom is cited. Although nitrogen-containing compounds having 2 or more carbon atoms may basically be used, the nitrogen-containing compound having 0 or 1 carbon atom is the most preferably used in order to maintain the concentration of CO being low in generated gas. And, though states of the nitrogen in the nitrogen-containing compound having 0 or 1 carbon atom are not especially limited except that the nitrogen exhibits a coordination ability to the metal components having the reaction accelerating ability to form the above molecular compound, it is preferable that the nitrogen has a —N═N— bond and/or a >N—N< bond in the structure of the nitrogen-containing compound in order to increase the nitrogen gas fraction and to reduce gas components of $NO_X$ and $NH_3$ in generated gas.

Examples of the nitrogen-containing compound having 0 or 1 carbon atom include hydrazine, carbodihydrazide, diaminoguanidine, triaminoguanidine, semicarbadide, thiosemicarbadide.

The oxidant component (b) in the molecular compound of the present invention is not especially limited except that the oxidant is a group having an ability to oxidize a carbon atom an d a hydrogen atom in the gas generant component (a) to $CO_2$ and $H_2O$, respectively. Examples of the group include $NO_3$ group and ClO group, particularly, $NO_3$ group in view of reducing white smoke mist.

The reaction accelerator component (c) in the molecular compound of the present invention is not especially limited except that the accelerator is a metal component being capable to be coordinated by the molecular of the gas generant component (a). Examples of the accelerator include Al, Mg, Ca, Cr, Cu, Zn, Mn, Fe, Co, Sr and Ni. Among them, the one having higher number of valency in the ion state is preferable because the number of n of the above oxidant component (b) become bigger and a use amount of co-oxidant is reduced.

The most suitable combination can be selected by each value of sensitivity (friction sensitivity and drop hammer sensitivity), burning rate, gas generating efficiency par unit weight and thermal stability resistance and so on, based on the combinations with the gas generant component (a) in view of an ability and a producing safety of the gas generant.

The existing ratio of the reaction accelerator component (c), the gas generator component (a) and the oxidant component (b) in the molecular compound of the present invention can not be change arbitrarily, but it is determined necessarily by the combination of three components, by the scope of the compound being able to stably exist and by synthesis method of the molecular compound.

Even though, the synthesis method of the molecular compound of the present invention is not specifically limited, for example, methods described in references such as Mem. poudres, 1952, Vol. 34, 159–166; Zh. Neorg. Khim., 1981, Vol. 26 (8), 2134–2137; and Izv. Sib. Otd. Akad. Nauk SSSR, Ser. Khim. Nauk, 1982, (2), 89-9 can be used.

Examples of the molecular compound of the present invention represented by the composition formula (I) include $Zn.2(N_2H_4).2(NO_3)$, $Zn.3(N_2H_4).2(NO_3)$, $Mn.2(N_2H_4).2(NO_3)$, $Co.3(N_2H_4).2(NO_3)$, $Ni.3(N_2H_4).2(NO_3)$, $Zn.3(H_3N_2CON_2H_3).2(NO_3)$ (hereafter, $H_3N_2CON_2H_3$ being abbreviated as CDH), $Sr.(CDH).2(NO_3)$, $Mn.3(CDH).2(NO_3)$, $Mn.2(CDH).2(NO_3)$, $Mg.3(CDH).2(NO_3)$, $Al.3(CDH).3(NO_3)$, $Co.3(CDH).2(NO_3)$, $Ni.3(CDH).2(NO_3)$, $Ca.2(CDH).2(NO_3)$, $Cr.3(CDH).3(NO_3)$, $Fe.3(CDH).2(NO_3)$, $Cu.(CDH).2(NO_3)$, $Cu.2(CDH).2(NO_3)$, $Cu.(DAG).2(NO_3)$ [DAG means diaminoguanidine], $Cu.2(DAG).2(NO_3)$ and $Cu.(TAG).2(NO_3)$ [TAG means triaminoguanidine]. The present invention is not limited by them.

Additionally, molecular compounds represented by the formula of $Co_jZn_k.(j+k)(N_2H_4).2(j+k)(NO_3)$ [when j is 1, k is 1, 2, 3 or 4 and when j is 1, 2, 3 or 4, k is 1] are included as heteronuclear molecular compounds in the molecular compound described above.

The content of the molecular compound in the gas generant composition of the present invention may be 100% by wt., but the molecular compound is more preferable to use together with the co-oxidant. Particularly, the existing ratio of th e gas generator component (a) and the oxidant component (b) in the compound satisfy that the oxidant component can completely oxidize carbon atom and hydrogen atom to $CO_2$ and $H_2O$, respectively in the molecular of the gas generator component. That is, when an oxygen balance is positive, it is not needed to use the co-oxidant. It is more preferable that the co-oxidant in the range from 1 to 20% by wt. may be used to reduce generating gases such as hydrogen gas.

In the molecular compound having negative oxigen balance in the above, the content of the molecular compound is depends on the kind of co-oxidant, preferably, the content is in the range from 100 to 40% by wt. in the gas generant composition, more preferably, 95 to 50% by wt.

Various kind of co-oxidants can be used in the present invention. Preferably, the co-oxidant is at least one selected from the group consisting of oxygen acid salts comprising a cation selected from alkaline metals or alkaline earth metals and a hydrogen not-containing anion, ammonium nitrates and metal peroxides. Examples of the oxygen acid salt include nitrate, nitrite, chlorate and perchlorate. Concretely, alkali metal salts or alkaline earth metal salts of nitric acids such as sodium nitrate, potassium nitrate, magnesium nitrate and strontium nitrate; alkali metal salts or alkaline earth metal salts of nitrous acids such as sodium nitrite, potassium nitrite, magnesium nitrite and strontium nitrite; alkali metal salts or alkaline earth metal salts of chloric acids such as sodium chlorate, potassium chlorate, magnesium chlorate and barium chlorate; and alkali metal salts or alkaline earth metal salts of perchloric acids such as sodium perchlorate, potassium perchlorate, magnesium perchlorate and barium perchlorate are cited. As metal peroxides, potassium peroxide and zinc peroxide are cited. The nitrates are particularly preferred as the co-oxidant of them.

In the case of use the co-oxidant in the present invention, the quantity of the co-oxidant in the gas generant composition depends on species of the molecular compound. The quantity is preferebly not more than 60% by weight, more preferebly in the range of 10 to 45% by weight.

The gas generant composition of the present invention may further contain a bonding agent. As the bonding agent, inorganic bonding agents such as silica, alumina and molybdenum bisulfide or organic bonding agents such as fine crystalline cellulose, poval and high molecular olygomer can be used. The quantity of the bonding agent in the gas generant is preferably not more than 5% by weight.

Furthermore, the gas generant composition of the present invention may contain a catalyst component in order to reduce slight amounts of gas components such as Co, $No_X$ and $NH_3$. As the catalyst component, metal oxides such as CuO, $MnO_2$ and $MoO_3$ and composite metal oxides such as $Bi_2MoO_6$ and $Co_2MoO_6$ can be used. Preferred quantity of the catalyst in the gas generant composition is not more than 10% by weight.

The gas generant composition of the present invention can preferably be prepared by mixing by powder-dry method. If required, mixing can be carried out in the present of water by wet method. The gas generant composition can be used by molding in the form of particle, pellet, disc and any appropriate forms.

The gas generant composition of the present invention is particularly useful as a gas generant for an air bag system provided to protect human body by applied to automobiles, aircrafts and so on.

EXAMPLE

The present invention will now be described in more detail by refering to examples. However, the present inveniton is not limited by these examples.

Examples 1 to 12

The gas generant compositions having components shown in Table 1 were prepared. Sensitivities (friction sensitivity and drop hammer sensitivity) by JIS determination method, decomposition temperature by differential thermal analysis method and heating loss of prepared gas generant compositions were determined. The results are given in Table 1.

TABLE 1

| | Gas generant composition | Composition ratio (wt %) | Friction sensitivity (kgf) | Drop hammer sensitivity (cm) | Decomposition temperature (° C.) | Heating loss (wt %) |
|---|---|---|---|---|---|---|
| Ex. 1 | $Zn.2(N_2H_4).2(NO_3)$ | 100 | 19.2 | 60 | 248 | 0.33 |
| Ex. 2 | $Zn.2(N_2H_4).2(NO_3)/KNO_3$ | 86/14 | 32.4 | 80 | 245 | 0.22 |
| Ex. 3 | $Mg.3(CDH).2(NO_3)/KNO_3$ | 60/40 | >36.0 | 50 | 261 | 0.00 |
| Ex. 4 | $Mg.3(CDH).2(NO_3)/NaNO_3$ | 64/36 | >36.0 | 30 | 264 | 0.04 |
| Ex. 5 | $Ca.3(CDH).2(NO_3)/KNO_3$ | 61/39 | >36.0 | 40 | 250 | 0.69 |
| Ex. 6 | $Cr.3(CDH).3(NO_3)/KNO_3$ | 74/26 | 12.8 | 10 | 208 | 0.05 |
| Ex. 7 | $Zn.3(CDH).2(NO_3)/KNO_3$ | 62/38 | >36.0 | 70 | 250 | 0.26 |
| Ex. 8 | $Zn.3(CDH).2(NO_3)/Sr(NO_3)_2$ | 61/39 | 28.8 | 90 | 255 | 0.13 |
| Ex. 9 | $Zn.3(CDH).2(NO_3)/KClO_4$ | 65/35 | 25.5 | 90 | 235 | 0.25 |
| Ex. 10 | $Zn.3(CDH).2(NO_3)/KNO_3/CuO$ | 59/36/5 | 32.4 | >100 | 202 | 0.35 |
| Ex. 11 | $Mn.3(CDH).2(NO_3)/KNO_3$ | 61/39 | >36.0 | 40 | 234 | 0.07 |
| Ex. 12 | $Sr.(CDH).2(NO_3)$ | 100 | 28.8 | 90 | 409 | 0.39 |

As shown in Table 1, it is apparent that the gas generant composition of the present invention exhibits sufficient properties of both decomposition temperature and heating loss as physical properties in practical use.

Examples 13 to 24 and Comparative Example 1

Gas generant compositions having composites shown in Table 2 were prepared. Quantity of generated gas, concentrations of generated CO and $NO_2$ of prepared gas generant composition were determined by ideal calculation. The results are given in Table 2.

As Comparative Example, quantity of generated gas, concentrations of generated CO and $NO_2$ of an sodium azide gas generant determined by ideal calculation were also shown in Table 2.

TABLE 2

| | Gas generant composition | Composition ratio (wt %) | Quantity of generated gas (mol/100 g) | Generated CO (ppm) | Generated $NO_2$ (ppm) |
|---|---|---|---|---|---|
| Comp. Ex. 1 | $NaN_3/CuO$ | 61/39 | 1.40 | 0 | 0 |
| Ex. 13 | $Mg.3(CDH).2(NO_3)/KNO_3$ | 60/40 | 2.71 | 2668 | 3 |
| Ex. 14 | $Mg.3(CDH).2(NO_3)/KNO_3/CuO$ | 54/36/10 | 2.44 | 566 | 10 |
| Ex. 15 | $Mg.3(CDH).2(NO_3)/NaNO_3$ | 64/36 | 2.90 | 3602 | 2 |
| Ex. 16 | $Zn.3(CDH).2(NO_3)/KNO_3$ | 62/38 | 2.56 | 1091 | 2 |
| Ex. 17 | $Zn.3(CDH).2(NO_3)/KNO_3/CuO$ | 59/36/5 | 2.43 | 387 | 5 |
| Ex. 18 | $Zn.3(CDH).2(NO_3)/NaNO_3$ | 66/34 | 2.73 | 1393 | 3 |
| Ex. 19 | $Zn.3(CDH).2(NO_3)/Sr(NO_3)_2$ | 61/39 | 2.70 | 2685 | 9 |
| Ex. 20 | $Mn.3(CDH).2(NO_3)/KNO_3$ | 61/39 | 2.59 | 1980 | 10 |
| Ex. 21 | $Mn.3(CDH).2(NO_3)/NaNO_3$ | 65/35 | 2.76 | 282 | 12 |
| Ex. 22 | $Mn.3(CDH).2(NO_3)/NaNO_3/CuO$ | 55/35/10 | 2.43 | 50 | 15 |
| Ex. 23 | $Co.3(CDH).2(NO_3)/KNO_3$ | 61/39 | 2.57 | 0 | 44 |
| Ex. 24 | $Ni.3(CDH).2(NO_3)/KNO_3$ | 61/39 | 2.57 | 0 | 51 |

As a result of the above, the gas genrant composition of the present invention shows large amount of generated gas and that concentrations of generated CO and $NO_2$ are in the practically usable scope.

Examples 25 to 26 and Comparative Example 2

Molecular compounds according to the present invention as shown in Table 3 were applied to an acute toxicity test and by oral administrating to a mouse in the following method. $LD_{50}$ values were also judged by the results of the test. The results are given in Table 3. $LD_{50}$ value of a sodium azide (J. D. P. Craham, British J. Pham acol., Vol. 1, 1(1949)) was also shown in Table 3 to compare.

<Acute Toxicity Test Method>

The compound to be applied to the test was suspended in water. Each 30 mg, 300 mg and 2000 mg of suspended compound per weight kg of the mouse were prepared. Each portion of suspended compound was oral administrated to ten mice to determine death rate and judged $LD_{50}$ value.

TABLE 3

| | Compound | Death rate of 2000 mg adm. | Death rate of 300 mg adm. | Death rate of 30 mg adm. | $LD_{50}$ level |
|---|---|---|---|---|---|
| Ex. 25 | $Zn.3(CDH).2(NO_3)$ | 10/10 | 3/10 | 0/10 | >300 mg/kg |
| Ex. 26 | $Zn.2(N_2H_4).2(NO_3)$ | 10/10 | 0/10 | 0/10 | >300 mg/kg |
| Comp. Ex. 2 | $NaN_3$ | — | — | — | 27 mg/kg |

Generally, it is known that when $LD_{50}$ is 300 mg/kg or more, it is general matter, and when $LD_{50}$ is 30 mg/kg or below, it is a drastic toxic matter. As shown by the results in Table 3, the compound according to the present invention is remarkably improved in the toxicity comparing with that of the sodium azide.

Examples 27 and 28

Ca.2(CDH).2($NO_3$)/Sr($NO_3$)$_2$ as Example 27 and Sr.1 (CDH).2($NO_3$) as Example 28 were applied to the test in the same manner as those of Example 13. The results are given in Table 4.

TABLE 4

| Ex. | Composition ratio (wt %) | Quantity of generated gas (mol/100 g) | Generated CO (ppm) | Generated $NO_2$ (ppm) |
|---|---|---|---|---|
| 27 | 73/27 | 2.88 | 2 | 14 |
| 28 | 100/0 | 2.49 | 0 | 75 |

Examples 29 and Comparative Example 3

(1) Synthesis of metal complex of carbodihydrazide 6.0 g of carbodihydrazide (CDH) was dissolved in 15 ml of water at 55° C. 5.95 g of zinc nitrate 6 hydrates was dissolved in 10 ml of warm water. The zinc nitrate aqueous solution was added to the CDH aqueous solution in the above. The mixture was transparent at immediately after mixing thereof. About one minute after, white precipitate was generated in the mixture. The mixture was stirred at 50° C. for 20 minutes and cooled to a room temperature, followed by adding 50 ml of ethanol to be completely precipitated. After filtration of the precipitate, the mixture was air-dried at a room temperature for 2 hours, and further dried in vacuum over day and night. The yield was 90.4%. By an analysis, the synthesized product was shown by the composition as Zn($NO_3$).3(CDH).

(2) Heat decomposition characteristics of the metal complex of carbodihydrazide

The zinc complex of carbodihydrazide synthesized in (1) described above was applied to a differential thermal gravimetric analysis.

For a purpose of comparison, the differential thermal gravimetric analysis of carbodihydrazide alone was also carried out.

The results are given in Table 5.

TABLE 5

| | Sample | Heat decomposition start temp. (° C.) | Heat decomposition temp. (° C.) |
|---|---|---|---|
| Ex. 29 | Zinc complex of carbodihydrazide | 215.5 | 267.3 |
| Comp. Ex. 3 | Carbodihydrazide alone | 142.5 | 188.5 |

As apparent from Table 5, both the heat decomposition start temperature and the heat decomposition temperature of the carbodihydrazide zinc complex were raised to be improved in the heat resistance.

Example 30 and Comparative Example 4

A zinc complex of carbodihydrazide was synthesized in the same manner as that of Example 29. The zinc complex of carbodihydrazide and potassium nitrate were blended in the weight ratio of 62/38 and homogeneously mixed. Then, the mixture was molded to a pellet of 7.5 mmϕ×2.5 mm by a hydraulic tablet molding machine to prepare a sample. 10 g of the sample was applied to a 7.5 litter in volume bomb test. 1 g of B/$KNO_3$ was used as an ignitor for igniting the gas generant, and the ignition was made with a nichrome wire.

For a purpose of comparison, a sodium azide gas generant was also applied to the bomb test.

The results of the combustion behavior are given in Table 6 and the results of the anylisis of the gas generant are given in Table 7.

TABLE 6

| | Gas generant composition | Combustion chamber pressure (kg/cm$^2$) | Tank pressure (kg/cm$^2$) | Time of reached to maximum tank pressure (msec) |
|---|---|---|---|---|
| Ex. 30 | Zn.($NO_3$)$_2$.3(CDH)/$KNO_3$ weight ratio: 62/38 | 51.8 | 5.9 | 47.5 |
| Comp. Ex. 4 | $NaN_3$/CuO weight ratio: 60/40 | 50.0 | 5.7 | 50.2 |

TABLE 7

| | Gas generant composition | Composition of generated gas | | | | | | |
|---|---|---|---|---|---|---|---|---|
| | | $O_2$ % | $N_2$ % | $CO_2$ % | CO % | NO ppm | $NO_2$ ppm | HCN ppm |
| Ex. 30 | Zn.($NO_3$)$_2$.3(CDH)/$KNO_3$ weight ratio: 62/38 | 12.8 | 77.3 | 11.0 | 300 | 45 | 100 | 1 |
| Comp. Ex. 4 | $NaN_3$/CuO weight ratio: 60/40 | 11.9 | 88.0 | 0.18 | 250 | 15 | 30 | 0 |

As shown by the above results, the performances of the gas generant of the present invention are almost the same as those of conventional gas generants. Furthermore, they are in the range that they can be further improved by more optimization. It is apparent that the gas generant of the present invention is further improved in the heat resistance to be in safer and practicaly usable range.

What is claimed is:

1. A method for inflating an air bag which comprises the steps of:

generating gas by combusting a gas generant complex comprising a molecular compound comprising (a) gas generator component; (b) oxidant component; and (c) reaction accelerator component, wherein the molecular compound is the compound represented by the composition formula (I):

$$M.mX.nY \quad (I)$$

wherein M is the reaction accelerator (c) representing Al, Mg, Ca, Cr, Cu, Zn, Mn, Fe, Co, Sr, Ni or another metal capable of forming the molecular compound of the composition formula (I);

X is the gas generator component (a) representing a carbodihydrazide;

Y is the oxidant component (b) representing $NO_3$, $ClO_4$, Cl, I or another anion capable of forming the molecular compound of the composition formula (I); and m and n are numbers fixed by combinations of components (a), (b) and (c), wherein m is a number of 1 to 3 and n is a number of 2 to 3; and inflating said air bag using said gas.

2. The method according to claim 1, wherein M represents Cu, Co, Ni, Mn or Zn.

3. The method according to claim 1, wherein M represents Cu, Co, Ni, Mn or Zn; Y represents $NO_3$, Cl or I; X represents a carbodihydrazide (CDH); n is 2; and m is a number of 1 to 3.

4. The method according to claim 1, wherein the molecular compound is selected from the group consisting of:

$Zn.3(H_3N_2CON_2H_3).2(NO_3)$,
$Mn.3(H_3N_2CON_2H_3).2(NO_3)$,
$Mg.3(H_3N_2CON_2H_3).2(NO_3)$,
$Mn.2(H_3N_2CON_2H_3).2(NO_3)$,
$Ca.2(H_3N_2CON_2H_3).2(NO_3)$, and
$Sr.1(H_3N_2CON_2H_3).2(NO_3)$.

5. The method according to claim 1 or 2, wherein X represents a carbodihydrazide (CDH).

6. The method according to claim 1 or 2, wherein Y represents $NO_3$, $ClO_4$ or another anion of oxygen acid salt.

7. The method according to claim 5, further comprising a bonding agent.

8. A method for inflating an air bag which comprises the steps of:

generating gas by combusting a gas generant composition comprising a gas generant complex comprising a molecular compound comprising (a) gas generator component; (b) oxidant component; and (c) reaction accelerator component, wherein the molecular compound is the compound represented by the composition formula (I):

$$M.mX.nY \quad (I)$$

wherein M is the reaction accelerator (c) representing Al, Mg, Ca, Cr, Cu, Zn, Mn, Fe, Co, Sr, Ni or another metal capable of forming the molecular compound of the composition formula (I);

X is the gas generator component (a) representing a carbodihydrazide;

Y is the oxidant component (b) representing $NO_3$, $ClO_4$, Cl, I or another anion capable of forming the molecular compound of the composition formula (I); and m and n are numbers fixed by combinations of components (a), (b) and (c), wherein m is a number of 1 to 3 and n is a number of 2 to 3, and a co-oxidant as a physical mixing component; and inflating said air bag using said gas.

9. The method according to claim 8, wherein M represents Cu, Co, Ni, Mn or Zn.

10. The method according to claim 8, wherein M represents Cu, Co, Ni, Mn or Zn; Y represents $NO_3$, Cl or I; X represents a carbodihydrazide (CDH); n is 2; and m is a number of 1 to 3.

11. The method according to claim 8, wherein the molecular compound is selected from the group consisting of:

$Zn.3(H_3N_2CON_2H_3).2(NO_3)$,
$Mn.3(H_3N_2CON_2H_3).2(NO_3)$,
$Mg.3(H_3N_2CON_2H_3).2(NO_3)$,
$Mn.2(H_3N_2CON_2H_3).2(NO_3)$,
$Ca.2(H_3N_2CON_2H_3).2(NO_3)$, and
$Sr.1(H_3N_2CON_2H_3).2(NO_3)$.

12. The method according to claim 8, which comprises a molecular compound selected from the group consisting of:

$Zn.3(H_3N_2CON_2H_3).2(NO_3)$,
$Mn.3(H_3N_2CON_2H_3).2(NO_3)$,
$Mg.3(H_3N_2CON_2H_3).2(NO_3)$,
$Mn.2(H_3N_2CON_2H_3).2(NO_3)$,
$Ca.2(H_3N_2CON_2H_3).2(NO_3)$, and
$Sr.1(H_3N_2CON_2H_3).2(NO_3)$;
and a nitrate as a co-oxidant.

13. The method according to claim 8, wherein the co-oxidant is an ammonium nitrate, a metal peroxide, or an oxygen acid salt which comprises a cation which is an alkaline metal or an alkaline earth metal, and the anion is free of hydrogen atoms.

14. The method according to claim 13, wherein the oxygen acid salt is a nitrate, a nitrite, a chlorate or perchlorate.

15. The method according to claim 8 or 9, wherein X represents a carbodihydrazide (CDH).

16. The method according to claim 8 or 9, wherein Y represents $NO_3$, $ClO_4$ or another anion of oxygen acid salt.

17. The method according to claim 15, further comprising a bonding agent.

18. The method according to claim 1, 8, or 13, further comprising a bonding agent.

19. The method according to claim 1, 8, or 13, further comprising a catalyst component.

20. The method according to claim 19, wherein the catalyst component is CuO, $MnO_2$ or $MoO_3$.

21. A method for inflating an air bag which comprises the steps of:

generating gas by combusting a gas generant composition comprising a gas generant complex comprising a molecular compound comprising (a) gas generator component; (b) oxidant component; and (c) reaction accelerator component, wherein the molecular compound is the compound represented by the composition formula (I):

$$M.mX.nY \quad (I)$$

wherein M is the reaction accelerator (c) representing Al, Mg, Ca, Cr, Cu, Zn, Mn, Fe, Co, Sr, Ni or another metal capable of forming the molecular compound of the composition formula (I);

X is the gas generator component (a) representing a carbodihydrazide;

Y is the oxidant component (b) representing $NO_3$, $ClO_4$, Cl, I or another anion capable of forming the molecular compound of the composition formula (I); and m and n are numbers fixed by combinations of components (a), (b) and (c), wherein m is a number of 1 to 3 and n is a number of 2 to 3, and a bonding agent; and inflating said air bag using said gas.

22. A method for inflating an air bag which comprises the steps of:

generating gas by combusting a gas generant composition comprising a gas generant complex comprising a molecular compound comprising (a) gas generator component; (b) oxidant component; and (c) reaction accelerator component, wherein the molecular compound is the compound represented by the composition formula (I):

$$M.mX.nY \quad (I)$$

wherein M is the reaction accelerator (c) representing Al, Mg, Ca, Cr, Cu, Zn, Mn, Fe, Co, Sr, Ni or another metal capable of forming the molecular compound of the composition formula (I);

X is the gas generator component (a) representing a carbodihydrazide;

Y is the oxidant component (b) representing $NO_3$, $ClO_4$, Cl, I or another anion capable of forming the molecular compound of the composition formula (I); and m and n are numbers fixed by combinations of components (a), (b) and (c), wherein m is a number of 1 to 3 and n is a number of 2 to 3, and a catalyst component; and inflating said aid bag using said gas.

23. A gas generant composition comprising a gas generant complex comprising a molecular compound comprising (a) gas generator component; (b) oxidant component; and (c) reaction accelerator component, wherein the molecular compound is the compound represented by the composition formula (I):

$$M.mX.nY \quad (I)$$

wherein M is the reaction accelerator (c) representing Al, Mg, Ca, Cr, Cu, Zn, Mn, Fe, Co, Sr, Ni or another metal capable of forming the molecular compound of the composition formula (I);

X is the gas generator component (a) representing a carbodihydrazide;

Y is the oxidant component (b) representing $NO_3$, $ClO_4$, Cl, I or another anion capable of forming the molecular compound of the composition formula (I); and m and n are numbers fixed by combinations of components (a), (b) and (c), wherein m is a number of 1 to 3 and n is a number of 2 to 3, and a co-oxidant as a physical mixing component.

24. The gas generant composition according to claim 23, wherein M represents Cu, Co, Ni, Mn or Zn; Y represents $NO_3$, Cl or I; X represents a carbodihydrazide (CDH); n is 2; and m is a number of 1 to 3.

25. The gas generant composition according to claim 23, wherein the molecular compound is selected from the group consisting of:

$Zn.3(H_3N_2CON_2H_3).2(NO_3)$, $Mn.3(H_3N_2CON_2H_3).2(NO_3)$, $Mg.3(H_3N_2CON_2H_3).2(NO_3)$, $Mn.2(H_3N_2CON_2H_3).2(NO_3)$, $Ca.2(H_3N_2CON_2H_3).2(NO_3)$, and $Sr.1(H_3N_2CON_2H_3).2(NO_3)$.

26. The composition according to claim 23, which comprises a molecular compound selected from the group consisting of $Zn.3(H_3N_2CON_2H_3).2(NO_3)$, $Mn.3(H_3N_2CON_2H_3).2(NO_3)$, $Mg.3(H_3N_2CON_2H_3).2(NO_3)$, $Mn.2(H_3N_2CON_2H_3).2(NO_3)$, $Ca.2(H_3N_2CON_2H_3).2(NO_3)$, and $Sr.1(H_3N_2CON_2H_3).2(NO_3)$;

and a nitrate as a co-oxidant.

27. The composition according to claim 23, wherein the co-oxidant is an ammonium nitrate, a metal peroxide, or an oxygen acid salt which comprises a cation which is an alkaline metal or an alkaline earth metal, and the anion is free of hydrogen atoms.

28. The composition according to claim 27, wherein the oxygen acid salt is a nitrate, a nitrite, a chlorate or perchlorate.

29. The composition according to claim 23 or 27, further comprising a bonding agent.

30. The composition according to claim 23 or 27, further comprising a catalyst component.

31. The composition according to claim 30, wherein the catalyst component is CuO, $MnO_2$ or $MoO_3$.

32. The gas generant composition according to claim 23, wherein M represents Cu, Co, Ni, Mn or Zn.

33. The gas generant composition according to claim 23 or 32, wherein X represents a carbodihydrazide (CDH).

34. The gas generant composition according to claim 23 or 32, wherein Y represents $NO_3$, $ClO_4$ or another anion of oxygen acid salt.

35. The composition according to claim 33, further comprising a bonding agent.

36. A gas generant composition comprising a gas generant complex comprising a molecular compound comprising (a) gas generator component; (b) oxidant component; and (c) reaction accelerator component, wherein the molecular compound is the compound represented by the composition formula (I):

$$M.mX.nY \quad (I)$$

wherein M is the reaction accelerator (c) representing Al, Mg, Ca, Cr, Cu, Zn, Mn, Fe, Co, Sr, Ni or another metal capable of forming the molecular compound of the composition formula (I);

X is the gas generator component (a) representing a carbodihydrazide;

Y is the oxidant component (b) representing $NO_3$, $ClO_4$, Cl, I or another anion capable of forming the molecular compound of the composition formula (I); and m and n are numbers fixed by combinations of components (a), (b) and (c), wherein m is a number of 1 to 3 and n is a number of 2 to 3, and a bonding agent.

37. A gas generant composition comprising a gas generant complex comprising a molecular compound comprising (a) gas generator component; (b) oxidant component; and (c)

reaction accelerator component, wherein the molecular compound is the compound represented by the composition formula (I):

$$M.mX.nY \quad (I)$$

wherein M is the reaction accelerator (c) representing Al, Mg, Ca, Cr, Cu, Zn, Mn, Fe, Co, Sr, Ni or another metal capable of forming the molecular compound of the composition formula (I);

X is the gas generator component (a) representing a carbodihydrazide;

Y is the oxidant component (b) representing $NO_3$, $ClO_4$, Cl, I or another anion capable of forming the molecular compound of the composition formula (I); and m and n are numbers fixed by combinations of components (a), (b) and (c), wherein m is a number of 1 to 3 and n is a number of 2 to 3, and a catalyst component.

38. A gas generant complex comprising a molecular compound comprising (a) gas generator component; (b) oxidant component; and (c) reaction accelerator component, wherein the molecular compound is selected from group consisting of:

$Mg.3(H_3N_2CON_2H_3).2(NO_3)$, $Ca.2(H_3N_2CON_2H_3).2(NO_3)$, $Sr.1(H_3N_2CON_2H_3).2(NO_3)$, $Al.3(H_3N_2CON_2H_3).3(NO_3)$, $Cr.3(H_3N_2CON_2H_3).3(NO_3)$, and $Fe.3(H_3N_2CON_2H_3).2(NO_3)$.

* * * * *